US011560758B2

(12) United States Patent
Spinnangr

(10) Patent No.: US 11,560,758 B2
(45) Date of Patent: Jan. 24, 2023

(54) DRILLING AND MILLING TOOL

(71) Applicant: Altus Intervention (Technologies) AS, Stavanger (NO)

(72) Inventor: Martin Spinnangr, Hafrsfjord (NO)

(73) Assignee: Altus Intervention (Technologies) AS, Stavanger (NO)

( * ) Notice: Subject to any disclaimer, the term of this patent is extended or adjusted under 35 U.S.C. 154(b) by 0 days.

(21) Appl. No.: 17/288,182

(22) PCT Filed: Dec. 11, 2019

(86) PCT No.: PCT/NO2019/050272

§ 371 (c)(1),
(2) Date: Apr. 23, 2021

(87) PCT Pub. No.: WO2020/122732

PCT Pub. Date: Jun. 18, 2020

(65) Prior Publication Data

US 2021/0404262 A1 Dec. 30, 2021

(30) Foreign Application Priority Data

Dec. 14, 2018 (NO) ..... 20181614

(51) Int. Cl.
*E21B 10/26* (2006.01)
*E21B 17/07* (2006.01)
*E21B 29/00* (2006.01)

(52) U.S. Cl.
CPC ..... *E21B 10/26* (2013.01); *E21B 17/07* (2013.01); *E21B 29/002* (2013.01)

(58) Field of Classification Search
CPC ..... E21B 10/26; E21B 17/07; E21B 29/02
See application file for complete search history.

(56) References Cited

U.S. PATENT DOCUMENTS

| | | | | |
|---|---|---|---|---|
| 7,198,119 | B1 | 4/2007 | Hall et al. | |
| 2011/0240367 | A1 | 10/2011 | Guidry et al. | |
| 2015/0136490 | A1 | 5/2015 | Broussard | |
| 2017/0159385 | A1* | 6/2017 | Krüger | E21B 29/10 |
| 2017/0328159 | A1* | 11/2017 | Haugland | E21B 29/002 |
| 2018/0179845 | A1 | 6/2018 | Pallin et al. | |
| 2018/0195348 | A1 | 7/2018 | Lange et al. | |
| 2018/0223616 | A1* | 8/2018 | Messa | E21B 10/567 |

FOREIGN PATENT DOCUMENTS

| | | |
|---|---|---|
| WO | 2008104179 | 9/2008 |
| WO | 2017097832 | 6/2017 |

* cited by examiner

*Primary Examiner* — Taras P Bemko
(74) *Attorney, Agent, or Firm* — GableGotwals

(57) ABSTRACT

A drilling assembly comprises a drill bit and a cutting assembly. The drilling assembly forms a longitudinal center axis. The drill bit and cutting assembly fastened to a rotatable spline drive assembly. The cutting assembly being resiliently displaceable to the drill bit along the center axis such that in a first position the drill bit is surrounded by the cutting assembly and in a second position a free end portion of the drill bit projects beyond the cutting assembly along the center axis. The cutting assembly comprises an endmill which comprises a central through hole which is complementary to the outer diameter of the drill bit. A method for cutting swarfs created by drilling with the endmill is described.

7 Claims, 2 Drawing Sheets

DRILLING AND MILLING TOOL

CROSS-REFERENCE TO RELATED APPLICATIONS

This United States application is the National Phase of PCT Application No. PCT/NO2019/050272 filed 11 Dec. 2019, which claims priority to Norwegian Patent Application No. 20181614 filed 14 Dec. 2018, each of which is incorporated herein by reference.

This invention concerns a drilling assembly for removal of an obstacle in a conduit. The obstacle may be a valve and the conduit may be a well tube in a petroleum well, and in particular a production tubing in a petroleum well. More particularly the drilling assembly comprises a drill bit and a mill. Even more particularly the mill is resiliently and axially displaceable to the drill bit. During operation a full weight on the drilling assembly is first on the drill bit and thereafter seamlessly and without a damaging hard approach transferred to the mill when the drill bit penetrates the obstacle. The obstacle is drilled and cut away without producing problematic swarf and metal pieces. In particular, swarfs created by the drill bit are cut to small fragments by the mill.

A completed petroleum well comprises valves in the production tubing. Such valves may be ball valves and flapper valves. On rare occasions such valves do not function properly. For example, due to corrosion, a closed valve does not reopen by ordinary means. Valves that are out of order may be removed by drilling or cutting tools. As this is a rare event, equipment for removal of obstacles in the production tubing is by advantage light and easy to mobilize on a need basis. Equipment that is operated by wireline is a preferred choice.

The obstacle, such as a valve, may be drilled away by using a drill bit. Drilling is a relative fast operation. However, drilling creates swarf, such as flutes of swarf. Drill bits with a large diameter produces more and larger swarf compared to drill bits of smaller diameter. Swarf are pieces of metal that may harm the operation of the well. In general, free pieces of metal are unwanted in a petroleum well.

Ball valves and flutter valves comprise curved surfaces. A drill bit without proper lateral support will slide on the curved surface until the first part of a hole is formed. This hole may not be aligned with the center line of the drilling tool, and the drilling operation may not be performed correctly as the hole is not centralized. This may harm or damage the drill bit.

An unprotected drill bit may be harmed or damaged on entering the well and during displacement through the well tube until the drill bit lands on the obstacle. An unprotected drill bit may also be harmed on a return to a surface.

Efficient drilling requires proper weight on the drill bit. If the weight is too large, the drill bit may break off. If the weight is too small, the drilling operation becomes very slow.

It is also known to cut away obstacles in a well tubing. Patent application WO2017/097832 discloses a mill head with a centre opening. The milling action is therefore faster and requires less energy as not all material is removed by milling. The centre opening will create a piece of metal that may drop into the well on penetration through the obstacle.

It is also known to remove obstacles in a well tubing using a tool with a centre drill bit and a hole saw. Patent applications WO2008/104179 and US2018179845 disclose tools of this kind. The hole saw produces a metal disc and the tool is provided with means for capturing and securing the metal disc on penetration through the obstacle. If the capturing means fail, the disc will drop into the well tubing.

A hole saw will have an outer diameter that is somewhat less than the internal diameter of the tubing. After removal of the obstacle the passage is narrower than the tubing above and below the passage, and the passage forms a restriction in the tubing.

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect the invention relates more particularly to a drilling assembly, said drilling assembly comprising a drill bit and a cutting assembly, said drilling assembly forming a longitudinal center axis;

said drill bit and cutting assembly being fastened to a rotatable spline drive assembly;

said cutting assembly being resiliently displaceable to the drill bit along the center axis such that in a first position the drill bit is surrounded by the cutting assembly, and in a second position a free end portion of the drill bit is projecting beyond the cutting assembly along the center axis. The cutting assembly comprises an endmill, said endmill comprises a central through hole which is complementary to the outer diameter of the drill bit. An axis of the through hole coincides with the center axis. An internal diameter of the through hole is adapted to the external diameter of the drill bit, i.e. complementary, such that the drill bit is displaceable through the through hole. An advantage of the central through hole being complementary to the outer diameter of the drill bit is that the drill bit is supported by the through hole.

The cutting assembly may comprise a house forming an internal wall, and a spline shaft may be provided with a support that extends from the spline shaft and slidable abuts the internal wall. Thereby the spline shaft and the drill bit is supported along the central axis which has the advantage that a free end portion of the drill bit will not drift away from the central axis on onset of the drilling operation.

The endmill may be frustoconical. This has the advantage that the obstacle is cut away from the center and the hole made by the drill bit and towards the circumference, thereby not forming larger particles that may drop further into the well.

The cutting assembly may comprise a face mill. This has the advantage that remaining structures from the obstacle inside the tubing is cut away.

A resilient member between the cutting assembly and an adapter at a connection end portion of the drilling assembly, may comprise a helical spring. The helical spring may be an external helical spring.

In a second aspect the invention relates more particularly to a method for removing an obstacle in a well tube, where the method comprises to position a free end portion of a rotatable drill bit on a surface of the obstacle. The method further comprises to:

position a rotatable endmill on the surface of the obstacle, said endmill comprises a central through hole which is complementary to the drill bit, said endmill being resiliently displaceable along a center axis to the drill bit, such that the endmill rests on the surface by a force created by a resilient member;

to drill a hole in the obstacle by the drill bit, said drill bit creates flutes of swarf; and to cut the flutes of swarf with the endmill into particles which are less than the flutes of swarf.

The method may comprise to drill through the obstacle, and thereafter to increase the weight on the endmill to cut through the obstacle with the endmill. This has the advantage that a force or a weight on the drill bit from a drive system is first applied to the drill bit and thereafter automatically transferred to the endmill when the drill bit passes through the obstacle.

The method may comprise to drill through the obstacle with the endmill and continue to drill through the obstacle with a face mill. This has the advantage that remaining structures from the obstacle after cutting though with the endmill is removed with the face mill.

In the following is described an example of a preferred embodiment illustrated in the accompanying drawings, wherein.

Figure 1:
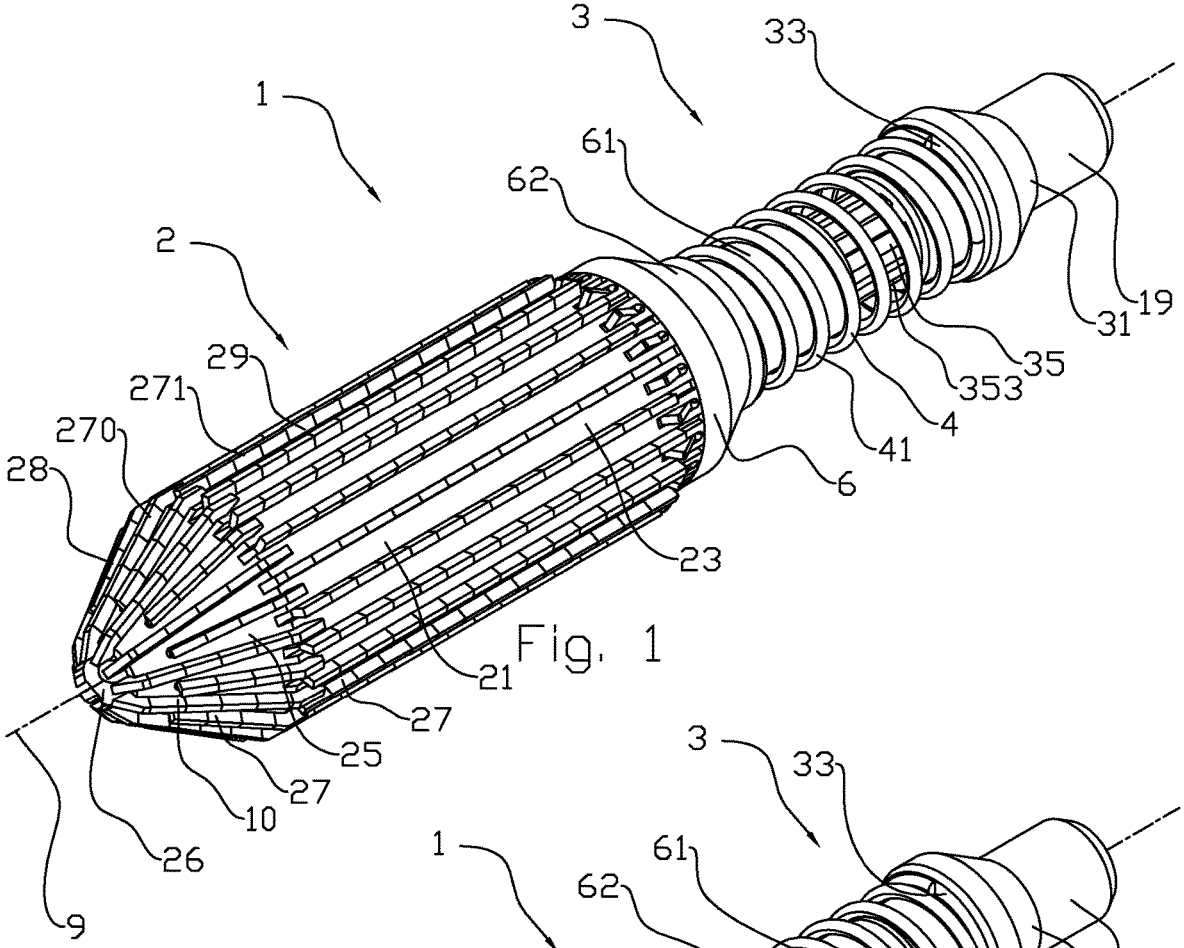
FIG. 1 shows in perspective a drilling assembly according to the invention where a drill bit is in a passive position.

In the drawings, the reference numeral 1 indicates a rotatable drilling assembly. The drilling assembly comprises a drill bit 5, a cutting assembly 2, rotatable spline drive assembly 3 and a resilient member 4. The drilling assembly 1 forms a drilling end portion 10 and an opposite connection end portion 19. The drilling assembly 1 forms a longitudinal centre axis 9 from the drilling end portion 10 to the connection end portion 19.

The rotatable spline drive assembly 3 comprises an adapter 31 at the end portion 19. The adapter 31 comprises an internal threaded recess 32, see FIGS. 3 and 4. The adapter 31 may be threadly connected to a drive system (not shown), said drive system is adapted to rotate the drilling assembly 1.

The adapter 31 is provided with a circumferential outer shoulder 33. The shoulder 33 is facing the drilling end portion 10. The adapter 31 is further provided with an end face 310 facing the drilling end portion 10, and a spline recess 34 formed in the end face 310.

A spline shaft 35 is in a fastening end 359 fastened at the spline recess 34. The spline shaft 35 forms an opposite drill end 350 with an internal threaded drill bit recess 351.

A lengthy drill bit 5 comprising a threaded end portion 59 is threadly fastened in the drill bit recess 351. A center axis of the spline shaft 35 and a center axis of the drill bit 5 coincide with the center axis 9 of the drilling assembly 1.

The drill bit 5 comprises a drill bit tip 50 and helical flutes 51.

A spline bushing 6 is fastened to spline shaft 35 in a manner which is rotary stiff and slidable along the longitudinal direction of the spline shaft 35. The spline shaft 35 is provided with at least one external longitudinal guiding ridge 353. The spline bushing 6 comprises complementary guiding grooves (not shown). The guiding ridges 353 and the guiding grooves prevent a rotation of the spline bushing 6 relative to the spline shaft 35.

The spline bushing 6 forms from the connection end portion 19 towards the drilling end portion 10 a stop face 69 which is perpendicular to the center axis 9, a straight portion 61 with a first external diameter, an enlarged portion 62 with a varying external diameter, the varying diameter being larger than the first external diameter, and a shoulder 63 is formed between the straight portion 61 and the enlarged portion 62.

The spline bushing 6 is at the opposite end of the stop face 69 provided with an external threaded sleeve 65. An internal wall 66 of the sleeve 65 forms a house 67 and the enlarged portion 62 forms an internal bottom 68 of the house 67.

The spline shaft 35 is provided with a fixed support 36 which is longitudinal displaceable within the house 67. The fixed support abuts the internal wall 66.

The cutting assembly 2 comprises a hollow support body 21. The support body 21 may be made up of several parts. In the drawings the support body 21 is shown as one piece of material. The support body 21 comprises a cylinder-shaped portion 23 and a frontal portion 25. The frontal portion 25 is shown as a frustoconical portion. The cylinder-shaped portion 23 is provided with internal threads and is threadly fixed to the external threads of the sleeve 65. The frontal portion 25 is provided with a central through hole 26. An axis of the through hole 26 coincides with the center axis 9. The internal diameter of the through hole 26 is adapted to the external diameter of the drill bit 5 such that the drill bit 5 is displaceable through the through hole 26.

Figure 2:
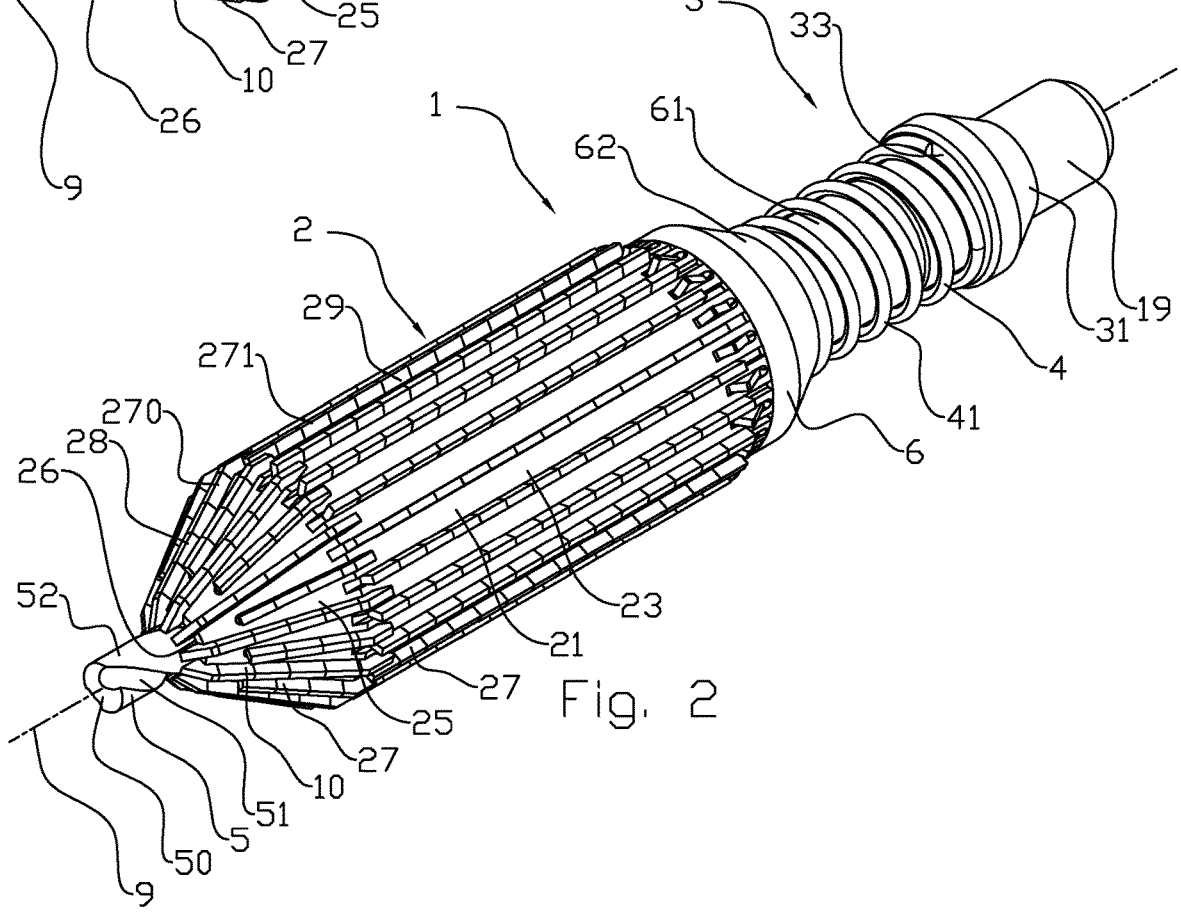
FIG. 2 show in the same scale as FIG. 1, the drilling assembly where the drill bit is in an extended position.

The support body 21 is on an exterior face shown provided with cutting elements 27. The exterior of the frontal portion 25 is shown provided with frontal cutting elements 270. The frontal cutting elements 270 may be oriented radially from the through hole 26 towards the cylinder-shaped portion 23 as shown in FIGS. 1 and 2. The frontal cutting elements 270 may be replaceable such as inserts. The frontal cutting elements 270 are not covering the through hole 26. The frontal cutting elements 270 form an endmill 28. The exterior of the cylinder-shaped portion 23 may be provided with lateral cutting elements 271. The lateral cutting elements 271 may extend in an axial direction as shown in FIGS. 1 and 2. The lateral cutting elements 271 may extend helically around the exterior of the cylinder-shaped portion 23 (not shown). The lateral cutting elements 271 may be replaceable such as inserts. The lateral cutting elements 271 form a face mill 29. In an alternative embodiment (not shown) the cutting elements 27, 270, 271 are replaced by an abrasive coating as known to the skilled person. In a further alternative embodiment (not shown) the cutting assembly 2 comprises a combination of abrasive coating and cutting elements, e.g. the frontal portion 25 may be provided with cutting elements 27, 270 and the cylinder-shaped portion 23 may be provided with the abrasive coating. The abrasive coating may comprise sintered diamond segments, sintered carbide segments, sintered cubic boron nitride (CBN) segments, crushed carbides, diamonds, or a combination of two or more of these materials for the best cutting effect.

The resilient member 4 is shown as a helical spring 41 in the drawings. In one end the helical spring 41 abuts the shoulder 33 of the adapter 31. In the opposite end the helical spring 41 abuts the shoulder 63 of the spline bushing 6.

Figure 3:
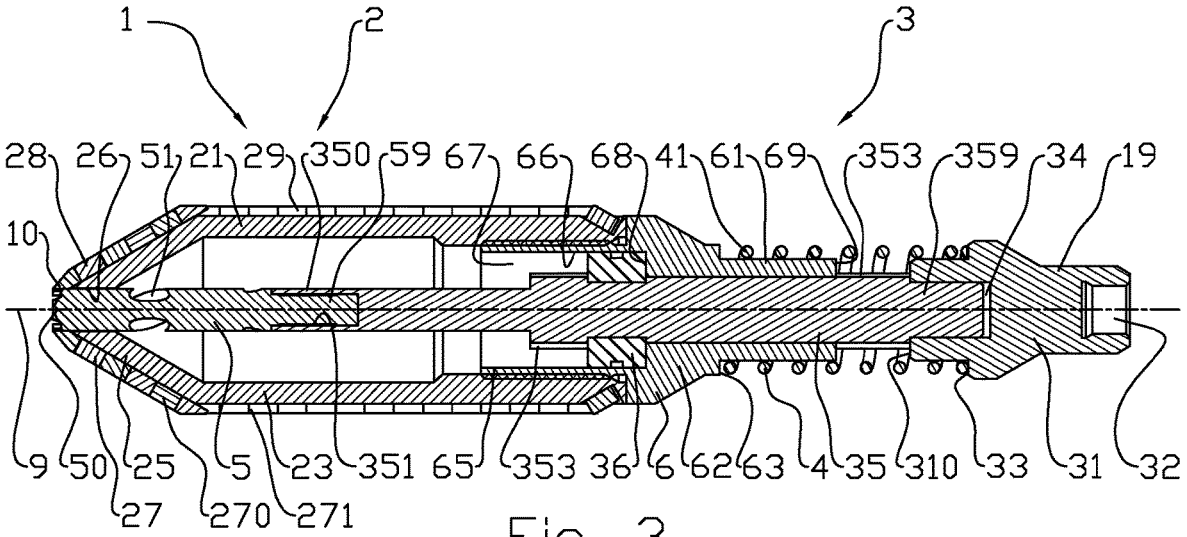
FIG. 3 shows in a smaller scale a sectional drawing of the drilling assembly where the drill bit is in the retracted position.
Figure 4:
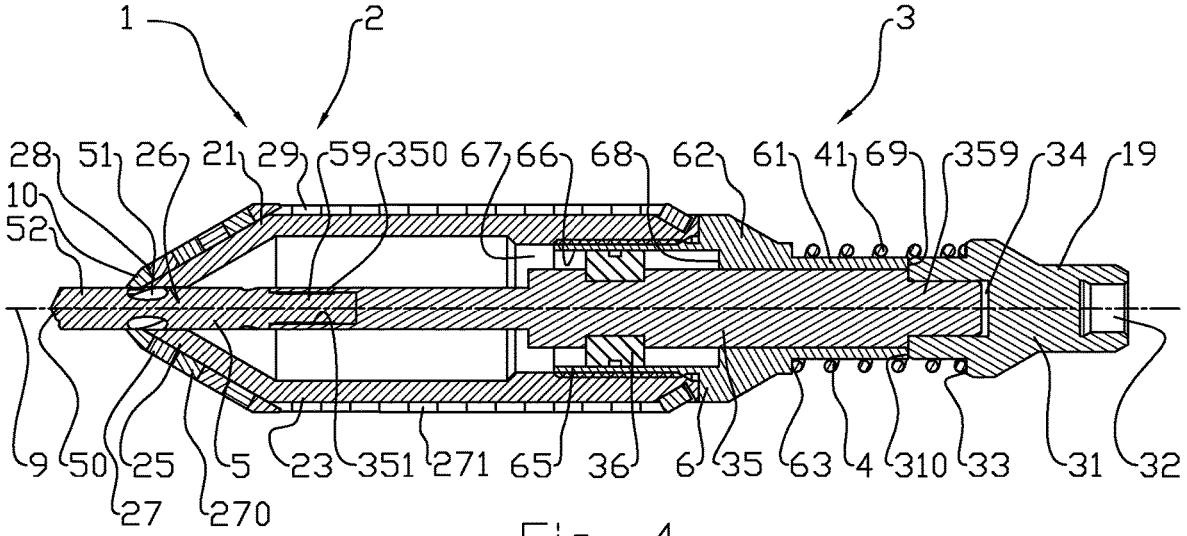
FIG. 4 shows in the same scale as FIG. 3, a sectional drawing of the drilling assembly where the drill bit is in the extended position.

The helical spring 41 is slightly compressed when the drilling assembly 1 is in a first passive position as shown in FIGS. 1 and 3. The helical spring 41 forces the adapter 31 apart from the spline bushing 6. The support 36 abuts the bottom 68 such that the spline bushing 6 is prevented from being further displaced along the spline shaft 35. In the passive position most of, or all of, the drill bit 5 is within the support body 21 as shown in FIG. 3. The drill bit tip 50 may optionally be flush with the leading portion of the frontal cutting elements 271, may be optionally flush with a leading portion of the frontal portion 25 of the support body 26 or optionally may be protruding slightly outside the leading portion of the frontal cutting elements 271.

The drilling assembly 1 is connected to the drive system. The drive system may be a tractor able to propel itself through a well tube. The tractor is provided with a means for rotating the drilling assembly 1. The tractor is provided with a cable for power supply from a surface.

The drive system displace the drilling assembly 1 trough e.g. a well tube (not shown). The tapered drilling end portion 10 makes the drilling assembly 1 passing smoothly constrictions and edges and without sticking to protrusions within the well tube. The drill bit 5 is protected by the cutting assembly 2.

The drive system positions the drilling end portion 10 of the drilling assembly 1 in contact with a surface of an object (not shown) to be removed from the well tube. The object may be a valve, such as a ball valve or a flapper valve, and the valve is not longer functioning properly. Most valves are positioned in well tubes that deviate from perfect vertical orientation. Tools and drive system will therefore due to gravity rest on the so-called low side of the well tube. The outer diameter of the cutting assembly 2 is slightly less than the internal diameter of the well tubing.

The drilling assembly 1 rests on the low side and the drilling end portion 10 abuts the object when drilling commences. The drill bit 5 is supported by the through hole 26 and the spline shaft 35 is supported by the support 36. This ensures that the drill bit 5 is kept steady during rotation and the drill bit tip 50 and a free end portion 52 of the drill bit 5 are kept at the center axis 9.

The drill bit tip 50 engages smoothly with the object without a damaging hard approach.

The drive system increases the weight on the drilling assembly 1. The cutting assembly 2 rests on the surface of the object and is displaced longitudinally on the spline shaft 35 towards the adapter 31 as the drill bit 5 advances into the object.

The drill bit 5 creates flutes of swarf (not shown) that is transported towards the frontal cutting elements 270 by the flutes 51. At the frontal cutting elements 270 the swarf is displaced radially outwards and the swarf is cut into small fragments, which are considerable smaller than the flutes of swarf, by cutting between the surface and the frontal cutting elements 270. The small fragments may be flushed out of the well by production flow, mud or other liquids, and the small fragments will not harm the operation of the well.

When the drill bit 5 penetrates the object, the weight on the drilling assembly 1 will force the adapter 31 further towards the spline bushing 6 until the end face 310 abuts the stop face 69. The frontal cutting elements 270 will then cut with full weight on the object until the whole object is cut away. As the frontal cutting elements 270 are pointed towards the bore hole created by the drill bit 5, the whole object is cut away without creating a disc shaped remaining that may drop further into the well.

The frontal cutting elements 270 rest on the object when the drill bit 5 penetrates the object. This avoids a damaging hard approach between the frontal cutting elements 270 and the object. As hard approaches are avoided between the drill bit 5 and the object, and between the frontal cutting elements 270 and the object, the drive system may apply full weight on the drilling assembly 1 through the whole operation of removing the object. Thereby, the operation is carried out efficiently.

A drill bit 5 penetrates an object faster than a cutting assembly. One advantage with the present invention is that a drill bit 5 with a relatively large diameter may be used. Drill bits 5 with a large diameter produce large amounts of swarfs. Swarfs are in general a problem in wells. The present drilling assembly 1 cuts the swarfs to small fragments which cause no problems. Thereby, more material in the centre of the object is removed by the fast drilling action and less material is to be removed by the slow cutting action. Thereby, the operation is carried out efficiently.

When the cutting assembly 2 has penetrated the object, there is no axial force on the frontal cutting elements 270 and the resilient member 4 displaces the spline bushing 6 together with the cutting assembly 2 away from the adapter 31 until the drilling assembly 1 is in a passive position.

After removal of the object, the drilling assembly 1 may remove any remaining of the object by the lateral cutting elements 271 and polish the interior of the well tube.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A drilling assembly, said assembly comprising:

a tapered drilling end portion;

a drill bit comprising a drill bit tip and helical flutes;

a cutting assembly comprising a hollow support body forming a cylinder-shaped portion and a frontal portion provided with a plurality of frontal cutting elements;

the drilling assembly forming a longitudinal center axis;

said drill bit and cutting assembly being fastened to a rotatable spline drive assembly;

said cutting assembly being resiliently displaceable to the drill bit along the center axis such that in a first position the drill bit is surrounded by the cutting assembly, and in a second position a free end portion of the drill bit projects beyond the cutting assembly along the center axis; and wherein the cutting assembly comprises a tapered endmill formed by the plurality of frontal cutting elements, said tapered endmill comprises a central, cylindrical through hole formed with an internal diameter adapted to an outer diameter of the drill bit, and the plurality of frontal cutting elements surrounding the through hole extend axially toward the center axis along the frontal portion, and a leading portion of the frontal cutting elements extend beyond the frontal portion, the drill bit tip being surrounded by the cylindrical through hole in the first position.

2. The drilling assembly according to claim 1, wherein the cutting assembly comprises a house forming an internal wall, and wherein a spline shaft is provided with a support that extends from the spline shaft and slidably abuts the internal wall.

3. The drilling assembly according to claim 1, wherein the tapered endmill is frustoconical.

4. The drilling assembly according to claim 1, wherein the cylinder-shaped portion is provided with lateral cutting elements thereon extending in an axial direction forming a face mill.

5. The drilling assembly according to claim 1, wherein a resilient member, located between the cutting assembly and an adapter at a connection end portion of the drilling assembly, comprises a helical spring.

6. A method for removing an obstacle in a well tube, the method comprises:

positioning a drilling assembly free end portion of a rotatable drill bit on a surface of the obstacle, the drilling assembly forming a longitudinal center axis, the drilling assembly further comprising a tapered drilling end portion, a drill bit comprising a tip and helical flutes; the drill bit and a cutting assembly comprising a hollow support body forming a cylinder-shaped portion and a frontal portion provided with a plurality of frontal cutting elements being fastened to a rotatable spline drive assembly; the cutting assembly being resiliently displaceable to the drill bit along the center axis such that in a first position the drill bit is surrounded by the cutting assembly, and in a second position a free end portion of the drill bit projects beyond the cutting assembly along the center axis; the cutting assembly comprises a tapered endmill formed by the plurality of frontal cutting elements, said tapered endmill comprises a central cylindrical through hole formed with an internal diameter adapted to the outer surface of the drill bit and the plurality of frontal cutting elements surrounding the through hole extending axially toward the center axis along the frontal portion, and a leading portion of the frontal cutting elements extending beyond the frontal portion, the drill bit tip is surrounded by the cylindrical through hole in the first position;

positioning the tapered endmill on the surface of the obstacle, said tapered endmill being resiliently displaceable along a center axis to the drill bit, such that the tapered endmill rests on the surface by a force created by a resilient member;

drilling a hole in the obstacle by the drill bit, said drill bit creates flutes of swarf;

cutting the flutes of swarf with the tapered endmill into particles which are less than the flutes of swarf; and drilling through the obstacle, and thereafter increasing weight on the tapered endmill to cut through the obstacle with the tapered endmill.

7. The method according to claim 6, wherein the method comprises drilling through the obstacle with the tapered endmill and continuing to drill through the obstacle with a face mill.

* * * * *